US009212523B2

(12) United States Patent
Yong et al.

(10) Patent No.: US 9,212,523 B2
(45) Date of Patent: Dec. 15, 2015

(54) DRILL BIT HAVING GEOMETRICALLY SHARP INSERTS

(75) Inventors: Zhou Yong, Spring, TX (US); Weiqi Yin, Houston, TX (US); Bradley J. Head, Oklahoma City, OK (US)

(73) Assignee: Smith International, Inc., Houston, TX (US)

( * ) Notice: Subject to any disclaimer, the term of this patent is extended or adjusted under 35 U.S.C. 154(b) by 542 days.

(21) Appl. No.: 13/309,389

(22) Filed: Dec. 1, 2011

(65) Prior Publication Data

US 2013/0140093 A1 Jun. 6, 2013

(51) Int. Cl.
*E21B 10/16* (2006.01)
*E21B 10/58* (2006.01)

(52) U.S. Cl.
CPC ..... *E21B 10/58* (2013.01); *E21B 10/16* (2013.01)

(58) Field of Classification Search
CPC ..... E21B 10/16; E21B 10/52; E21B 10/56
USPC ..... 175/331, 431, 336
See application file for complete search history.

(56) References Cited

U.S. PATENT DOCUMENTS

| | | | | |
|---|---|---|---|---|
| 1,905,066 | A * | 4/1933 | Scott | 175/341 |
| 2,117,679 | A * | 5/1938 | Reed | 175/356 |
| 3,126,973 | A * | 3/1964 | Kiel | 175/378 |
| 4,471,845 | A | 9/1984 | Jurgens | |
| 4,475,606 | A * | 10/1984 | Crow | 175/431 |
| 5,370,195 | A | 12/1994 | Keshavan et al. | |
| 6,332,503 | B1 | 12/2001 | Pessier et al. | |
| 6,345,673 | B1 * | 2/2002 | Siracki | 175/353 |
| 6,367,568 | B2 * | 4/2002 | Steinke et al. | 175/331 |
| 6,484,826 | B1 | 11/2002 | Anderson et al. | |
| 7,086,488 | B2 * | 8/2006 | Richman | 175/374 |
| 7,886,851 | B2 | 2/2011 | Hall et al. | |
| 8,028,771 | B2 | 10/2011 | Keshavan et al. | |
| 8,047,307 | B2 * | 11/2011 | Pessier et al. | 175/336 |
| 2004/0163851 | A1 * | 8/2004 | McDonough et al. | 175/374 |
| 2005/0194191 | A1 * | 9/2005 | Chen et al. | 175/426 |
| 2006/0277009 | A1 * | 12/2006 | Torres et al. | 703/6 |
| 2008/0035380 | A1 | 2/2008 | Hall et al. | |
| 2008/0035387 | A1 | 2/2008 | Hall et al. | |
| 2008/0314647 | A1 | 12/2008 | Hall et al. | |
| 2009/0051211 | A1 | 2/2009 | Hall et al. | |
| 2009/0133938 | A1 | 5/2009 | Hall et al. | |
| 2011/0192651 | A1 | 8/2011 | Lyons et al. | |
| 2012/0111630 | A1 * | 5/2012 | Chen et al. | 175/45 |

* cited by examiner

*Primary Examiner* — Kenneth L Thompson

(57) ABSTRACT

A drill bit configured for boring holes or wells into the earth, the drill bit having a face and a plurality of zones, the drill bit having geometrically sharp inserts located in an inner zone and non-geometrically sharp inserts located in an outer zone.

24 Claims, 9 Drawing Sheets

DRILL BIT HAVING GEOMETRICALLY SHARP INSERTS

FIELD

The present application relates to drill bits used for earth boring, such as water wells; oil and gas wells; injection wells; geothermal wells; monitoring wells, mining; and, other operations in which a well-bore is drilled into the Earth.

BACKGROUND

Specialized drill bits are used to drill well-bores, boreholes, or wells in the earth for a variety of purposes, including water wells; oil and gas wells; injection wells; geothermal wells; monitoring wells, mining; and, other similar operations. These drill bits come in two common types, roller cone drill bits and fixed cutter drill bits.

Wells and other holes in the earth are drilled by attaching or connecting a drill bit to some means of turning the drill bit. In some instances, such as in some mining applications, the drill bit is attached directly to a shaft that is turned by a motor, engine, drive, or other means of providing torque to rotate the drill bit.

In other applications, such as oil and gas drilling, the well may be several thousand feet or more in total depth. In these circumstances, the drill bit is connected to the surface of the earth by what is referred to as a drill string and a motor or drive that rotates the drill bit. The drill string typically comprises several elements that may include a special down-hole motor configured to provide additional or, if a surfaces motor or drive is not provided, the only means of turning the drill bit. Special logging and directional tools to measure various physical characteristics of the geological formation being drilled and to measure the location of the drill bit and drill string may be employed. Additional drill collars, heavy, thick-walled pipe, typically provide weight that is used to push the drill bit into the formation. Finally, drill pipe connects these elements, the drill bit, down-hole motor, logging tools, and drill collars, to the surface where a motor or drive mechanism turns the entire drill string and, consequently, the drill bit, to engage the drill bit with the geological formation to drill the well-bore deeper.

As a well is drilled, fluid, typically a water or oil based fluid referred to as drilling mud is pumped down the drill string through the drill pipe and any other elements present and through the drill bit. Other types of drilling fluids are sometimes used, including air, nitrogen, foams, mists, and other combinations of gases, but for purposes of this application drilling fluid and/or drilling mud refers to any type of drilling fluid, including gases. In other words, drill bits typically have a fluid channel within the drill bit to allow the drilling mud to pass through the bit and out one or more jets, ports, or nozzles. The purpose of the drilling fluid is to cool and lubricate the drill bit, to stabilize the well-bore from collapsing, to prevent fluids present in the geological formation from entering the well-bore, and to carry fragments or cuttings removed by the drill bit up the annulus and out of the well-bore. While the drilling fluid typically is pumped through the inner annulus of the drill string and out of the drill bit, drilling fluid can be reverse-circulated. That is, the drilling fluid can be pumped down the annulus of the well-bore (the space between the exterior of the drill pipe and the wall of the well-bore), across the face of the drill bit, and into the inner fluid channels of the drill bit through and up into the drill string.

Roller cone drill bits were the most common type of bit used historically and typically featured two or more rotating cones with cutting elements, or teeth, on each cone. Roller cone drill bits typically have a relatively short period of use as the cutting elements and support bearings for the roller cones typically wear out and fail after only 50 hours of drilling use.

Because of the relatively short life of roller cone bits, fixed cutter drill bits that employ very durable polycrystalline diamond compact (PDC) cutters, tungsten carbide cutters, natural or synthetic diamond, other hard materials, and combinations thereof, have been developed. These bits are referred to as fixed cutter bits because they employ cutting elements positioned on one or more fixed blades in selected locations or randomly distributed. Unlike roller cone bits that have cutting elements on a cone that rotates, in addition to the rotation imparted by a motor or drive, fixed cutter bits do not rotate independently of the rotation imparted by the motor or drive mechanism. Through varying improvements, the durability of fixed cutter bits has improved sufficiently to make them cost effective in terms of time saved during the drilling process when compared to the higher, up-front cost to manufacture the fixed cutter bits.

A drill bits performance can be measured by it rate of penetration, its life in hours to failure, and its footage. These performance characteristics are all related, as a faster rate of penetration will typically decrease the life of a drill bit, and at a given rate of penetration an increase in the life of the drill bit will result in a greater footage.

When a drill bit fails it must be replaced before drilling can resume. Such a failure may be a total failure of the drill bit, or it may be a subset of cutters on the face of the drill bit. Anytime a cutter must be replaced the entire drill bit must be removed from the bore hole and the cutter or drill bit replaced. The process of removing a drill bit from the bore hole takes a significant amount of time that could otherwise be spent drilling. Therefore, it is desirable to design a drill bit that has a maximum footage so that less drill bits and cutters are consumed during the drilling process. At the same time, the drill bit must be able to be operated at a reasonable rate of penetration to minimize the time spent drilling.

An ideal drill bit is one that would allow a high rate of penetration while maintaining a high footage. This would minimize the length of time required to drill a borehole, as it would require less drill bit changes while at the same time drilling at a high rate of penetration. Thus, there exists a need for a drill bit designed for high rate of penetration with an extended life.

SUMMARY

An embodiment of a drill bit for earth boring includes a bit body having a first end and a second end spaced apart from the first end, as well as a centerline extending through the bit body. The drill bit includes a connection for coupling the bit body to a rotating means that provides rotational torque to the bit body. The drill bit includes a first zone having at least one cutting element. The first zone extends between the centerline to a first radius. The at least one cutting element imparts a first amount of energy to a formation or earth proximate the first zone of the drill bit to remove a first volume of the earth. A second zone of the drill bit has at least another cutting element. The second zone extends between the first radius and a second radius greater than the first radius. The at least another cutting element imparts a second amount of energy to the earth proximate the second zone of the drill bit to remove a second volume of the earth substantially equal to the first volume. One of the cutting element and the another cutting element are selected such that the first energy and the second energy are substantially equal.

Another embodiment of the drill bit includes a bit body having a first end and a second end spaced apart from the first end, as well as a centerline extending through the bit body. The drill bit includes a connection for coupling the bit body to a rotating means that provides rotational torque to the bit body. The drill bit further includes a first zone having at least one cutting element. The first zone extends between the centerline to a first radius. The at least one cutting element causes said first zone to have a first energy density. The drill bit also includes a second zone having at least another cutting element. The second zone extends between the first radius and a second radius greater than the first radius. The at least another cutting element causes the second zone to have a second energy density. In addition, at least one of the cutting element and the another cutting element are selected such that an energy density of the first zone and an energy density of the second zone are substantially equal.

Furthermore, in this embodiment of the drill bit, the first energy density includes a first amount of energy imparted by the cutting element to the earth proximate the first zone to remove a first volume of the earth. Likewise, the second energy density includes a second amount of energy imparted by the another cutting element to the earth proximate the second zone to remove a second volume of the earth.

In yet another embodiment, a drill bit has a bit body with a first end, a second end spaced apart from the first end, a centerline extending through the drill bit, and a connection for coupling the drill bit to a drill string. The drill bit is designed with a process that includes positioning at least one cutting element in a first zone of the drill bit. The first zone extends between the centerline to a first radius. The cutting element is selected to remove a first volume of earth proximate the first zone when the bit body is rotated. At least another cutting element is positioned in a second zone of the drill bit. The second zone extends between the first radius and a second radius greater than the first radius. The another cutting element is selected to remove a second volume of earth proximate the second zone when the bit body is rotated. A first amount of energy required by the cutting element to remove the first volume is calculated, and a second amount of energy required by the another cutting element to remove the second volume is also calculated. At least one of the cutting element and the another cutting element are adjusted, such as by either repositioning the cutting element, reorienting the cutting element, selecting a different cutting element (e.g., a different material and/or different aggressiveness), such that the first amount of energy and the second amount of energy is substantially equal.

In this particular embodiment, the process also includes calculating the first volume the cutting element removes proximate the first zone when the bit body is rotated and calculating the second volume the another cutting element removes proximate the second zone when the bit body is rotated. The first radius is adjusted such that the first volume is substantially equal to the second volume.

In yet another embodiment, methods of designing a drill bit are disclosed. These methods include designing a bit body that has a first end, a second end spaced apart from the first end, a centerline extending through the bit body, and a connection for coupling the bit body to a rotating means for providing rotational torque to the bit body. The method also includes selecting and positioning at least one cutting element in a first zone of the drill bit. The first zone extends between the centerline to a first radius. At least another cutting element is selected and positioned in a second zone of the drill bit. The second zone extends between the first radius and a second radius greater than the first radius. A first volume that the cutting element removes proximate the first zone when the bit body is rotated is calculated, as is a second volume the another cutting element removes proximate the second zone when the bit body is rotated. A first amount of energy required by the cutting element to remove the first volume is calculated, as is a second amount of energy required by the another cutting element to remove the second volume. adjusting at least one of said cutting element and said another cutting element such that said first amount of energy and said second amount of energy is substantially equal. At least one of the cutting element and the another cutting element are adjusted, such as by either repositioning the cutting element, reorienting the cutting element, selecting a different cutting element (e.g., a different material and/or different aggressiveness), such that the first amount of energy and the second amount of energy is substantially equal.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

As used herein, "incorporated by reference" is meant to include only those portions of the incorporated references which do not conflict with the present disclosure.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

DETAILED DESCRIPTION

Figure 1:
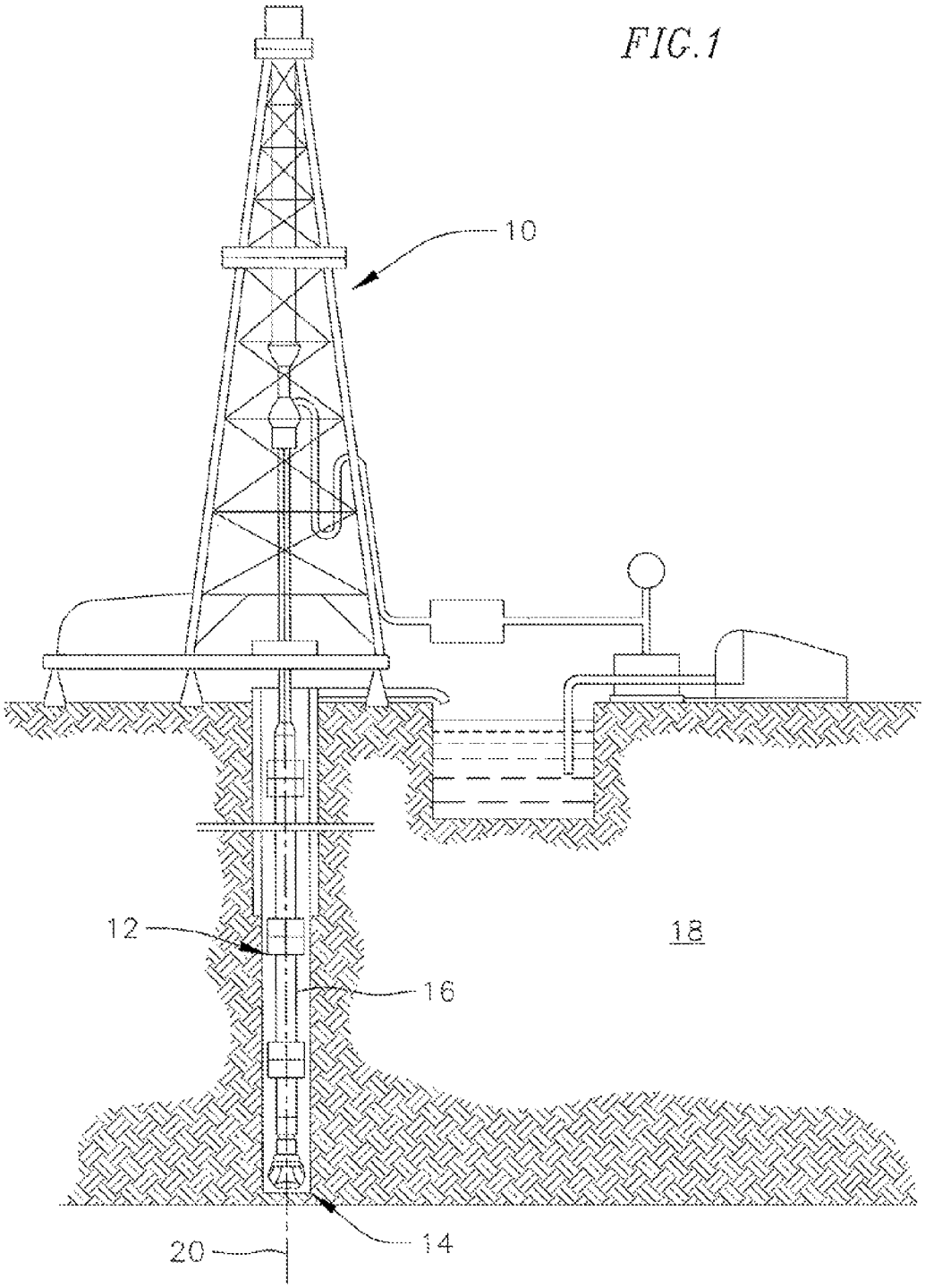
FIG. 1 is a cross-view of a drill rig drilling into a formation.

FIG. 1 illustrates a cross-section of a drill rig 10 having a drill string 12 coupled to a drill bit 14. The drill string 12 extends into a well bore 16 in a formation 18. The drill string 12 has an axis 20 and the drill bit 14 is configured to rotate about the axis 20. The rotation of the drill bit 14 is caused by a means of providing rotary torque or force, such as a motor, downhole motor, drive at the surface, or other means, as described above in the background. The means of providing torque is coupled to the drill string 12 to rotate the drill bit 14. The drill string 12 provides a force that pushes the drill bit 14 against the formation 18. The combination of the force and the rotation of the drill bit 14 cause the formation 18 to degrade at an interface of the drill bit 14 and the formation 18. In some embodiments the means of providing torque may be coupled directly to the drill bit 14. The drill bit 14 is capable of drilling oil and gas wells onshore and offshore; geothermal wells; water wells; monitoring and/or sampling wells; injection wells; directional wells, including horizontal wells; bore holes in mining operations; bore holes for pipelines and telecommunications conduits; and other types of wells and boreholes.

Figure 2:
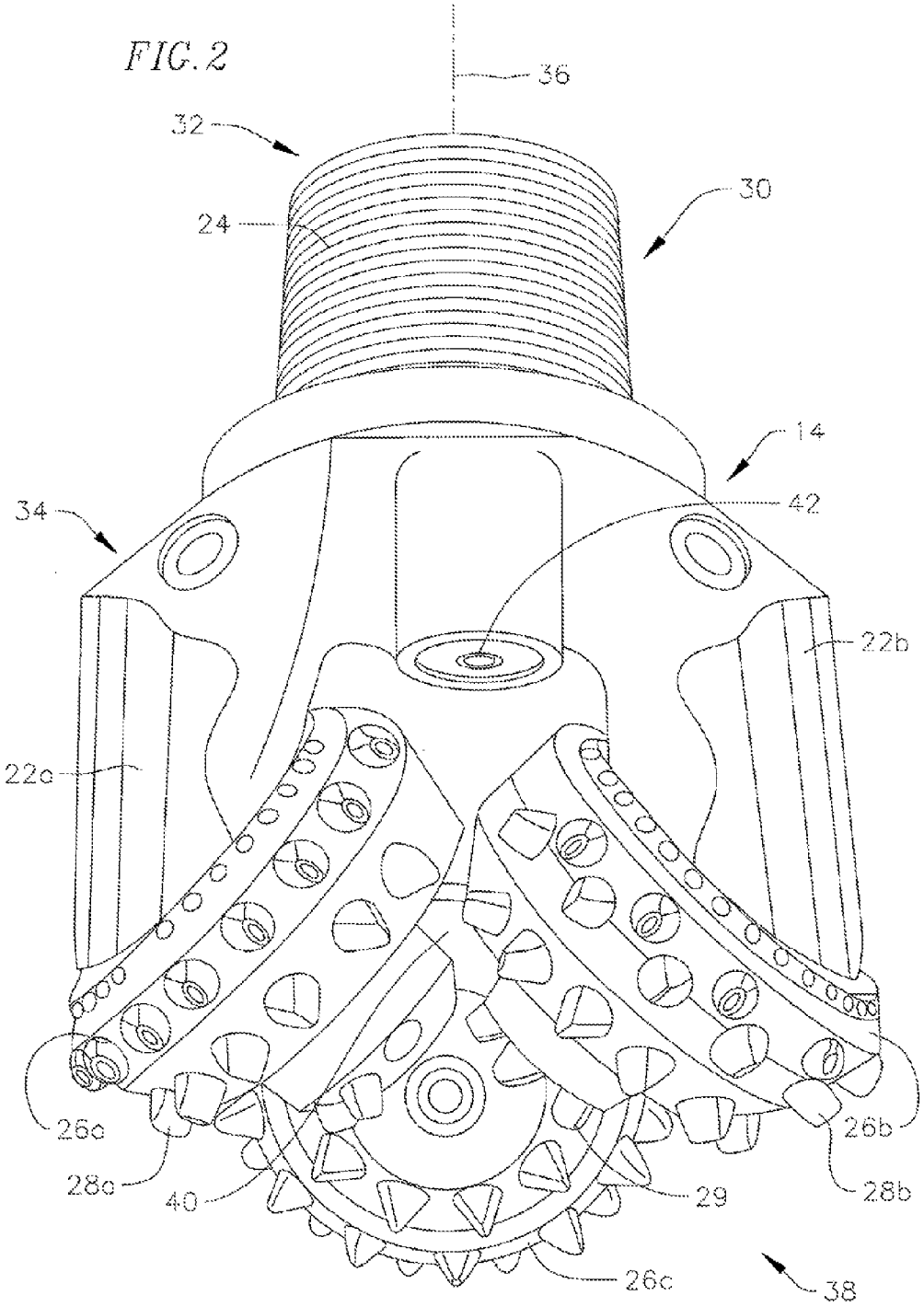
FIG. 2 is an isometric view of a standard tri-cone drill bit.

FIG. 2 illustrates an isometric view of the drill bit 14 of FIG. 1, which in this example is a tri-cone, or roller cone, drill bit. The drill bit 14 includes a first end 30 that includes a shank or connection means 32 configured to couple or mate the drill bit 14 to the drill string 12 or a drill shaft that is coupled to the means of providing rotary torque or force, such as a motor, downhole motor, drive at the surface, or other means, as described above in the background. FIG. 2 illustrates a typical pin connection with threads 24 that have a chamfer configured to reduce stress concentrations at the end of the threads 24 and to ease mating with a box connection in the drill string 12. Of course, the connection means 32 can be a box connection as known in the art, bolts, welded connection, joints, and other means of connecting the drill bit 12 to a motor, drill string, drill, top drive, downhole turbine, or other means of providing a rotary torque or force. The threads 24 typically are of a type described as an American Petroleum Institute (API) standard connection of various diameters as known in the art, although other standards and sizes fall within the scope of the disclosure. The threads 24 are configured to operably couple with the threads of a corresponding or analogue box connection in the drill string, collar, downhole motor, or other connection to the bit as known in the art. The sealing face provides a mechanical seal between the drill bit 14 and the drill string 12 and prevents any drilling fluid passing through an inner diameter of the drill string 12 and the drill bit 14 from leaking out.

The drill bit 12 has a bit body 34. The bit body 34 includes one or more drill bit legs 22*a*, 22*b*, and 22*c* (not shown) connected thereto that extend past the bit body 34 in both a radial direction from the centerline 36 and a vertical direction towards and proximate to a second end 38 of the drill bit 14, as illustrated in FIG. 2. The bit body 34 can be formed integrally with the drill bit legs 22*a*, 22*b*, and 22*c*, such as being milled out of a single steel blank. Alternatively, the drill bit legs 22*a*, 22*b*, and 22*c* can be welded to the bit body 34.

The one or more legs 22*a*, 22*b*, 22*c* include a cone 26*a*, 26*b*, and 26*c*, respectively having cutters 28 for impacting the formation 18. The cutters 28 illustrated in FIG. 2 may be a polycrystalline diamond type cutter formed from two materials: a polycrystalline diamond material which forms at least a portion of the upper surface of the cutter that engages the formation and a substrate; a tungsten carbide insert and/or a metal insert or tooth. The cutters may be formed from one or more materials selected from tungsten carbide, natural or synthetic diamond, polycrystalline cubic boron nitride, hardened steel, and other hard materials capable of drilling the formation. Although reference may be made herein to polycrystalline diamond, it is intended that polycrystalline cubic boron nitride would also be applicable to the particular embodiment.

In some embodiments the cutters may have a carbide substrate and a polycrystalline diamond layer. The carbide substrate may have a grain size of between 2 microns (0.00007874 inches) and 12 microns (0.000472 inches). The polycrystalline diamond layer may form an impact resistant tip (polycrystalline diamond body), such as is described in US2009/0051211, for example paragraphs [0048] and [0049]; and US2009/0133938, for example paragraphs [0007] through [0010] and [0044] through [0061], these publications are herein incorporated by reference in their entirety. Such cutters may comprise a diamond bonded body and a cemented metal carbide substrate. At least a portion of such cutters may comprise a conical shape with a conical side wall terminating at an apex (tip).

The polycrystalline diamond layer may form a coating over at least a portion of the end of the substrate. Some examples of such polycrystalline diamond coated cutters are described in U.S. Pat. No. 5,370,195 and U.S. Pat. No. 6,484,826, these patents are herein incorporated by reference in their entirety. The coating may be uniform in thickness or non-uniform.

The polycrystalline diamond layer may be comprised of multiple sub-layers. The multiple sub-layers may be formed of the same or different materials. The multiple sub-layers may vary in catalyst content, diamond content, average diamond grain size, porosity, and/or carbide content, for example. The multiple sub-layers may vary forming a gradient or forming an interruption in one or more properties.

In one or more embodiments, the polycrystalline diamond layer may comprise a first region comprising a thermally stable polycrystalline diamond material. The first region may form all or only a portion of the upper surface of the polycrystalline diamond layer. The first region may form all or only a portion of the polycrystalline diamond layer. In an embodiment, the thermally stable polycrystalline diamond material may be formed by removing, e.g., by leaching, the catalyst, e.g., cobalt, from the polycrystalline diamond bonded structure. Suitable leaching methods are described in U.S. Pat. No. 8,028,771, for example column 8, line 5 through column 9, line 22, the disclosure of which is incorporated herein by reference. In another embodiment, the thermally stable polycrystalline diamond material may be formed from fully dense polycrystalline diamond, i.e., no catalyst was used in forming the polycrystalline diamond, or from a more thermally compatible binder than cobalt, for example silicon, silicon carbide, carbonates, as well as reaction products formed by reacting the catalyst with a reactant which renders the resulting reacted product more thermally stable than the cobalt.

Each cone 26*a*, 26*b*, and 26*c* is rotatably coupled to its associated leg 22*a*, 22*b*, and 22*c* such that it can turn relative to the leg. The cone 26*a*, 26*b*, and 26*b* may be rotatably coupled to the legs 22*a*, 22*b*, and 22*c* through various combinations of bearings, journals, and seals as known in the art that allow for rotation of the cones 26*a*, 26*b*, and 26*c*.

Representative cutters 28*a* and 28*b* are positioned on the cones 26*a* and 26*b*, respectively, at selected radial distances from the centerline 36 depending on various factors, including the desired rate-of-penetration, hardness, and abrasiveness of the expected geological formation or formations to be drilled, and other factors. For example, two or more cutters 28*a* and 28*b* may be placed at the same radial distance from the centerline 36, typically on different cones 26*a* and 26*b* and, therefore, possibly cut over the same path through the formation 18. In other drill bits, two or more cutters 28*a* and 28*b* are positioned at only slightly different radii from the centerline 36 of the drill bit 14, again, typically on different cones 26*a* and 26*b*, so that the path that each cutter 28*a* and 28*b* makes through the formation 18 overlaps slightly with the another cutter at a further radial distance from the centerline 36 of the drill bit 14.

The cutters 28*a* and 28*b* at the same or nearly the same radial distance from the centerline 36 of the drill bit 14 typically, although not necessarily, are on different cones 26*a* and 26*b* of the drill bit 14. In addition, the distance a given cutter 28*b* travels during a single revolution of the drill bit 14 increases as the radial distance of the cutter 28*b* from the centerline 36 of the drill bit 14 increases. Thus, a cutter 28*b* positioned at a greater radial distance from the centerline 36 of the drill bit 14 travels a greater distance for each revolution of the drill bit 14 than another cutter 29 positioned at a lesser radial distance from the centerline 36 of the drill bit 14. As such, the first cutter 28*b* at the greater radial distance typically would wear faster than the second cutter at the lesser radial distance.

Other features of the drill bit 14 include one or more nozzle bosses 42 that are an integral part of the bit body 34. The nozzle bosses 42 have a fixed area through which drilling fluid or drilling mud flows after passing through an inner diameter of the drill string 12 and through the inner diameter or annulus of the drill bit 14. Typically, the nozzle bosses 42 are configured to receive a jet, nozzle, or port of various diameters or sizes and optionally includes threads or other means to secure the jets or nozzles in position within the nozzle boss 42 as known in the art. The jets, ports, or nozzles are typically field replaceable to adjust the total flow area of the jets or nozzles and have a selected diameter chosen to balance the expected rate-of-penetration and, consequently, the rate at which drill cuttings are created by the bit and removed by the drilling fluid, the necessary hydraulic horsepower, and capabilities of the drilling rig facilities, particularly the pressure rating of the drilling rig's fluid management system and the pumping capacity of its mud pumps, among other factors. In some instances, a blank jet nozzle may be placed in a particular nozzle boss 42 preventing any fluid from flowing through that particular boss 42. Such a configuration is useful for jetting operations when initially drilling into the seafloor in a new offshore well. Conversely, no jet nozzle can be used when desired.

Figure 3:
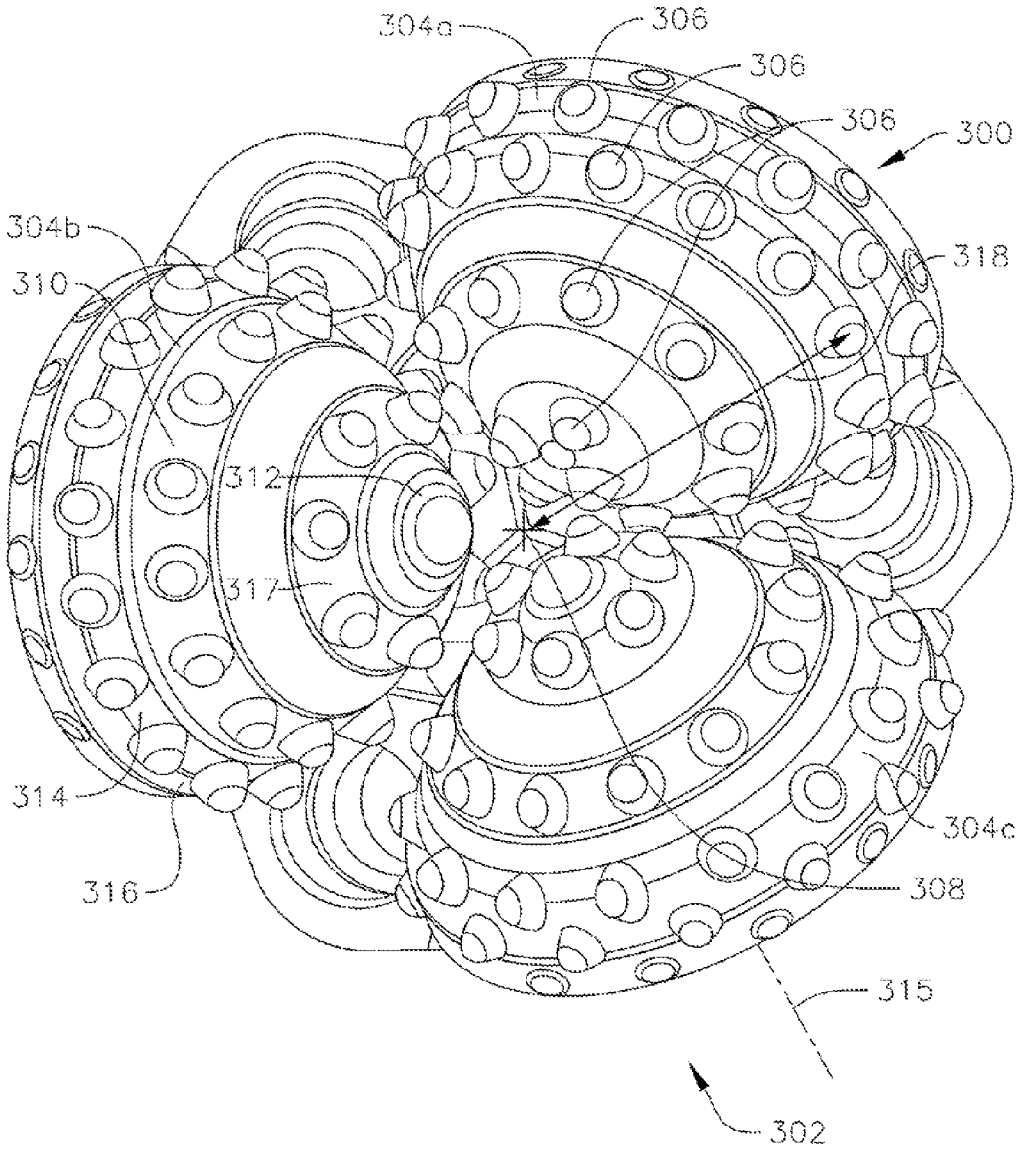
FIG. 3 is an orthogonal view of a face of a standard drill bit.

FIG. 3 illustrates a face 302 of a common tri-cone drill bit 300. The drill bit 300 has three cones 304*a*, 304*b*, and 304*c*, each of which have representative cutters 306 mounted to each of the cones 304*a*, 304*b*, 304*c*. The cones 304*a*, 304*b*, and 304*c* each have a gauge end 314 and a nose 312. (Note, these features and others are illustrated only with respect to one or more of the cones in FIG. 3 for simplicity and clarity. One of skill in the art would understand from the text and the drawings those elements present for the drill bit 300.) The cutters 306 impact a formation and remove material from the formation. The cutters 306 may be impact cutters, where the impact of the cutter 306 with the formation causes the formation to degrade. The cutters 306 shown in FIG. 3 are impact cutters, but embodiments of the present disclosure are suitable for use with both impact cutters, abrasive cutters, and any other type of cutter. Additionally, embodiments of the disclosure are suitable for any rotating drill bit, such as fixed cutter and/or PDC drill bits, and are not limited to a tri-cone drill bit.

Each cone 304*a*, 304*b*, and 304*c* rotates about a cone axis 315 (only illustrated for cone 304*c* for clarity) while the drill bit 300 rotates about a central axis 308 that extends out of the page. A torque is applied to the drill bit 300 to cause it to rotate about the central axis 308. The torque can be applied by a drill string, a downhole drive assembly, or other torque means. When downhole, an interaction of the drill bit 300 and the formation causes the cones 304 to rotate about the cone axis 315. The rotation of the cone 304*c*, for example, allows different portions of the cone 304*c* and therefore different cutters to impact the formation and thereby extend the life of the drill bit 300.

The cones 304*a*, 304*b*, and 304*c* each have multiple rows of cutters 306 as shown in FIG. 3. For example, an outermost row, or heel row 316 of cutters 306 is disposed at the gauge end 314 of the cone 304*c*. A second row, or middle row, 310 of cutters 306 is disposed between the heel row 316 of cutters 306 and the nose 312 of cone 304*a*. The heel row 316 of cutters 306 typically has a greater number of cutters 306 than the middle row 310 of cutters 306. Nose row 317 is the closest to the nose 312. More rows of cutters 306, while not presently illustrated, are possible and drill bits are not limited to a specific number of cutters or rows.

As the drill bit 300 rotates at an angular velocity, each cutter 306 translates relative to the formation at the same angular velocity with a tangential, linear velocity component that is proportional to the distance the cutter 306 is from the central axis 315 of the drill bit 300. Each cutter 306 has a kinetic energy dependent upon the linear velocity of the cutter 306. As each cutter 306 impacts the formation, a portion of formation is degraded and a volume of material is removed. The volume of material removed from the formation is dependent upon a number of factors, including the type of formation, the cutter geometry, the cutter material, the kinetic energy of the cutter, and the force, also referred to as weight-on-bit, applied to the formation.

Of these various factors, the weight on bit and the type of formation are generally constant across the face of the drill bit. The kinetic energy of the cutter can be controlled by varying the rotational velocity of the bit, but at any given location, the kinetic energy is always dependent upon the distance from that given point to the center axis of the drill bit. Because the kinetic energy varies across the face of the drill bit, if all of the other factors are the same, each cutter will potentially remove a different amount of material when the cutter impacts the formation.

The linear velocity of the cutter 306*a* is proportional to a distance 318 that the cutter 306*a* is from the center axis 308 of the drill bit 300. The kinetic energy of the cutter 306*a* is related to the linear velocity and is proportional to the square of the linear velocity. Therefore, the kinetic energy of the cutter 306 is proportional to the square of the distance 318 the cutter 306*a* is from the center axis 308. The further the cutter 306*a* is from the central axis 308 of the drill bit, the more material it should be able to remove, assuming the other factors do not change. The amount of material the cutter should be able to remove is defined as the cutters potential.

However, because each cutter is fixed to the drill bit, each cutter translates in an axial direction at the same rate as the drill bit. Therefore, for any swept unit area of a drill bit, the volume of material removed is constant across the face of the drill bit. Even though a cutter at the outer edge of the drill bit is capable of removing a greater amount of material for a unit swept area due to its higher kinetic energy, the actual volume of material removed is limited by the forward motion of the drill bit. So the actual amount of material removed for a unit swept area of a cutter at the outer edge cannot exceed the amount of material for a unit swept area removed by a cutter near the center of the drill bit.

The actual amount of material removed by a cutter divided by its potential amount of material removed will be called a cutter's utilization. For example, if a cutter has four times as much kinetic energy as a cutter closer to the center of the bit, it should remove four times as much material per unit area. However, the cutter is limited to removing the same amount of material per unit area as the other cutter, so its utilization is 1 divided by 4, or 25%. So only ¼ of the potential cutting ability would be realized at the cutter.

Figure 4:
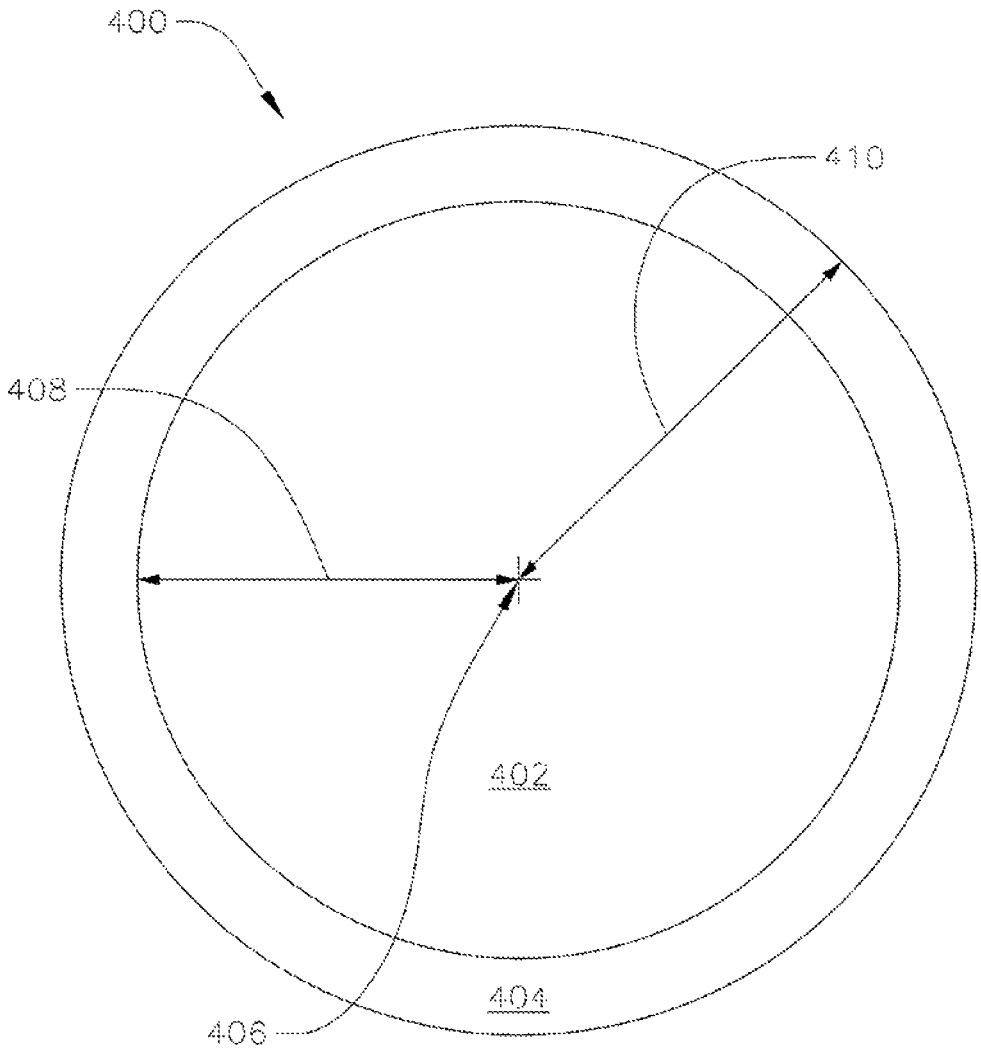
FIG. 4 is an energy map showing 2 zones of equal energy in a standard drill bit.

FIG. 4 illustrates an exemplary energy map 400 showing the total kinetic energy in two zones of a standard drill bit. In the discussion of FIG. 4, reference will be made to the drill bit of FIG. 3, although the energy map 400 of FIG. 4 does not necessarily correspond to the drill bit 300. Characteristics of the drill bit 300 can be analyzed using the kinetic energy map 400. The energy map 400 illustrates areas of equal kinetic energy at the face 302 of the drill bit 300. Because the drill bit 300 turns about the central axis 308, the energy map 400 is a circle having a central axis 408 aligned with the center axis 308 of the drill bit 300 and includes an area of a formation, such as formation 18 illustrated in FIG. 1, swept by the face 302 of the drill bit 300. The energy map 400 of FIG. 4 is consistent with a drill bit having uniform cutters across its face and equally distributed. This distribution of cutters approximates a standard drill bit and shows two energy zones 402, 404 of equal total kinetic energy.

The two energy zones 402, 404 of FIG. 4 take the form of a circle for the first zone 402 and an annulus for the second zone 404. For a given circular area of the energy map, the total kinetic energy can be found by summing the magnitude of the kinetic energy at each point of the area. In other words, integrating across the area of the energy zone results in a total kinetic energy. One of ordinary skill in the art would recognize that the integration of the kinetic energy across each circular zone results in a total kinetic energy that is proportional to the fourth power of a radius of the circular zone. Thus the total kinetic energy for the first zone 402 is proportional to the fourth power of a first zone radius 408. The kinetic energy for the second zone 404 can be found by calculating the kinetic energy for the outer circle having a second zone radius 410 and subtracting, the kinetic energy of the first zone 402. In a standard drill bit, it is useful to find the first zone radius 408 to determine its size relative to the second zone. Since the zones have an equal total kinetic energy by definition, we know that the total kinetic energy of the first zone 402 is equal to the total kinetic energy of the second zone. The ratio between the first zone radius 408 and the second zone radius 410 can then be found as follows, where r1 is the first zone radius and r2 is the second zone radius, $$r1^4 = r2^4 - r1^4$$

$$2 * r1^4 = r2^4$$

$$\frac{r1^4}{r2^4} = \frac{1}{2}$$

$$\frac{r1}{r2} = \sqrt[4]{\frac{1}{2}} = 0.841$$

Thus, in a standard drill bit having an equal distribution of like cutters, the ratio of the first zone radius 410 to the second zone radius 410 is 0.841. The relative areas of the first zone 402 and the second zone 404 can be calculated as well, which in turn is the same as the relative volume of material removed by the first zone and the second zone. Since area is proportional to the square of the radius, the area of the first zone is proportional to $r1^2$ and the area of the second zone is proportional to the area of a circle with the second zone radius r2, or $r2^2$, minus the area of the first zone, $r1^2$. Therefore the relationship of area of the first zone and the second zone can be calculated as follows, where a1 is the area of zone one, a2 is the area of zone 2, r1 is the radius of the first zone and r2 is the radius of the second:

$$a1 = r1^2, a2 = r2^2 - r1^2$$

$$\frac{a1}{a2} = \frac{r1^2}{r2^2 - r1^2}$$

$$\frac{a1}{a2} = \frac{\frac{r1^2}{r2^2}}{\frac{r2^2 - r1^2}{r2^2}}$$

$$\frac{a1}{a2} = \frac{\frac{r1^2}{r2^2}}{1 - \frac{r1^2}{r2^2}}$$

$$\frac{a1}{a2} = \frac{\left(\frac{r1}{r2}\right)^2}{1 - \left(\frac{r1}{r2}\right)^2}$$

$$\frac{a1}{a2} = \frac{\left(\sqrt[4]{\frac{1}{2}}\right)^2}{1 - \left(\sqrt[4]{\frac{1}{2}}\right)^2}$$

$$\frac{a1}{a2} = \frac{\sqrt{\left(\frac{1}{2}\right)}}{1 - \sqrt{\left(\frac{1}{2}\right)}}$$

$$\frac{a1}{a2} = 2.414$$

In a standard drill bit with equally distributed cutters, the area of the first zone 402 is over twice as large as the area of the second zone 404. The volume of material removed by a zone of the drill bit 300 is directly proportional to the area of the zone 402 of the drill bit 300. Therefore cutters in the area of the first zone 402 are removing over twice as much volume of material than cutters in the second zone 404 despite the zones 402, 404 having the same amount of kinetic energy.

The utilization of the cutters of each zone can be found by dividing the actual volume removed, which is proportional to the area of the zone, by the total kinetic energy of the zone, which is proportional to the potential amount of material removed by the cutters in the zone. Since the zones by definition have equal kinetic energy, the utilization is dependent solely upon the ratio of the areas of the zones. Therefore, the utilization of the first zone is over twice as high as the utilization of the second zone 404.

The average kinetic energy for each cutter can also be calculated by dividing the total kinetic energy by the total number of cutters in a zone. Since we assumed the cutters were evenly distributed, the number of cutters in a zone is dependent upon the area of the zone. Because the first zone has a greater area and therefore more cutters, but the same total kinetic energy, the first zone has a much lower kinetic energy per cutter. The first zone 402 is identified as a low energy zone and the second zone is identified as a high energy zone. Note that since only relative values of energy are calculated, the low energy zone and the high energy zone are identified in relation to the other zone, with the terms high and low carrying only a relative relationship between the zones.

Figure 5:
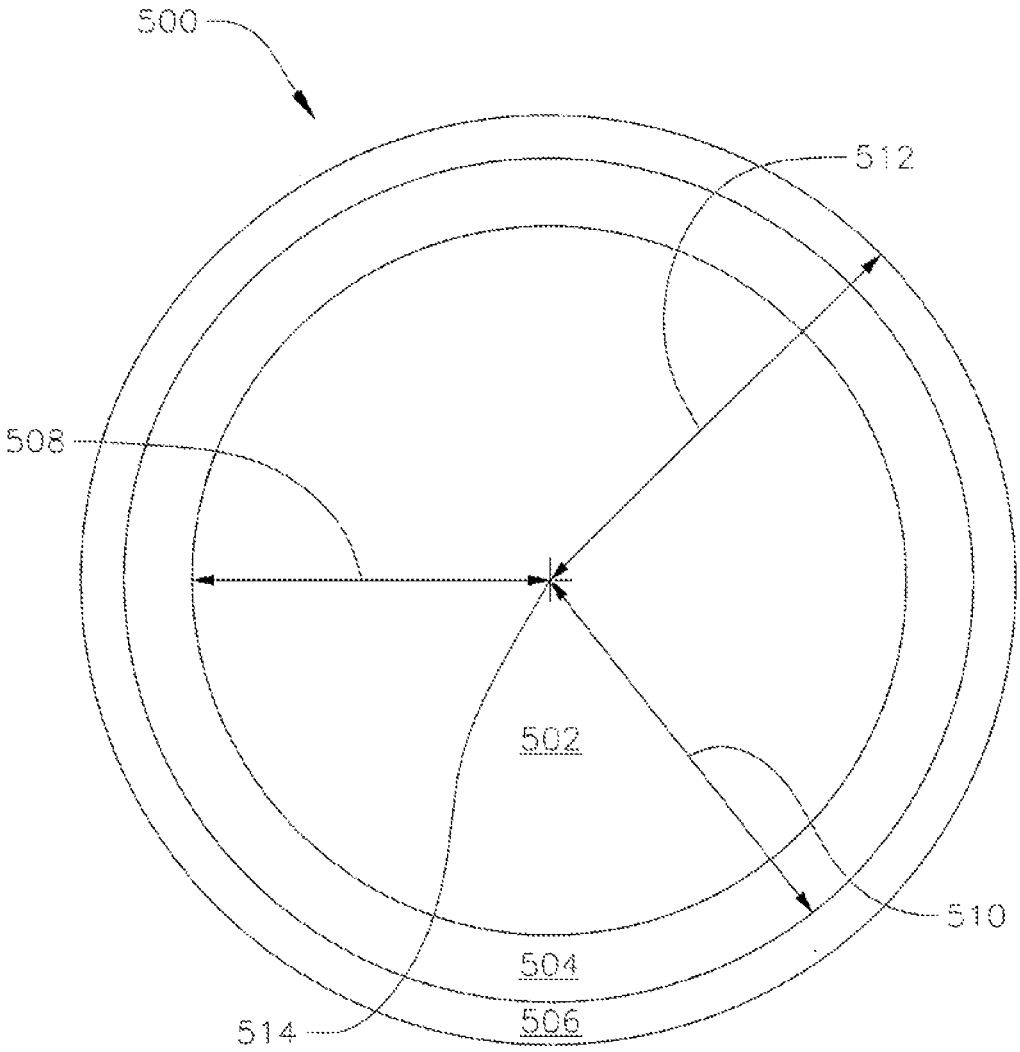
FIG. 5 is an energy map showing 3 zones of equal energy in a standard drill bit.

Other numbers of zones are possible. For example, FIG. 5 shows an energy map 500 for a drill bit having a first kinetic energy zone 502, a second kinetic energy zone 504, and a third kinetic energy zone 506, with each kinetic energy zone having the same total kinetic energy. The first energy zone is in the shape of a circle, while the second and third energy zones are each in the shape of an annuls. The energy zones have a central axis 514 and a radius for each of the kinetic energy zones. The radius for each of the kinetic energy zones can be found using the previous methodology. Let r1 be a first zone radius 508, r2 be a second zone radius 510, and r3 be a third zone radius 512. The following calculation is used to find the relative radii in a typical drill bit:

$$r1^4 \pm r2^4 - r1^4 = r3^4 - r2^4$$

$$2 * r1^4 = r2^4$$

$$r1^4 = \frac{r2^4}{2}$$

$$r1^4 = \left(\frac{1}{2}\right) r2^4$$

$$\frac{r1}{r2} = \sqrt[4]{\frac{1}{2}}$$

$$\frac{r1}{r2} = 0.841$$

$$r2^4 - r1^4 = r3^4 - r2^4$$

$$r2^4 - \frac{r2^4}{2} = r3^4 - r2^4$$

$$\frac{3 * r2^4}{2} = r3^4$$

$$r2^4 = \frac{2}{3} * r3^4$$

$$r2 = \sqrt[4]{\frac{2}{3} * r3^4} = 0.9036 * r3$$

$$r1 = \sqrt[4]{\frac{1}{2}} . * r2 = \sqrt[4]{\frac{1}{2}} . * \sqrt[4]{\frac{2}{3}} * r3 = \sqrt[4]{\frac{2}{6}} = 0.760 * r3$$

A drill bit having an equal distribution of like cutters divided into three zones of equal kinetic energy has a first zone 502 with a first zone radius 508 that is 0.76 times the third zone radius 512 and the second zone 504 has a second zone radius 510 that is 0.9036 times that of the third zone 506. The relative areas of each of the energy zones can be solved as follows:

$$a1 = \frac{\left(\frac{d1}{d2}\right)^2}{1 - \left(\frac{d1}{d2}\right)^2} * a2 = \frac{.841^2}{1 - .841^2} * a2$$

$$a1 = 2.414 * a2$$

$$a1 + a2 = \frac{\frac{d2^2}{d3}}{1 - \frac{d2^2}{d3}} * a3$$

$$2.414 * a2 + a2 = \frac{\frac{d2^2}{d3}}{1 - \frac{d2^2}{d3}} * a3$$

$$3.414 * a2 = \frac{\frac{d2^2}{d3}}{1 - \frac{d2^2}{d3}} * a3$$

$$a2 = \frac{\frac{d2^2}{d3}}{1 - d2^{2^2}} * \frac{a3}{3.414}$$

$$a2 = \frac{.9036^2}{1 - .9036^2} * \frac{a3}{3.414}$$

$$a2 = 1.303 * a3$$

$$a1 = 2.414 * 1.303 * a3$$

$$a1 = 3.145 * a3$$

As before, there is a considerable variation in the area of each of the energy zones and therefore a considerable variation in the utilization of the cutters and the kinetic energy per cutter. Since the total kinetic energy of each zone is the same, the utilization of each zone is dependent upon the relative areas of the zones. The utilization of the first zone 502 is over three times as high as the utilization of the third zone 506. The first zone 502 is a low energy zone, the second zone 504 is a mid energy zone, and the third zone 506 is a high energy zone. Again, the use of the terms low, mid, and high are in relation to the different zones and do not denote or suggest any absolute value.

The energy zones having a lower relative area are inefficient as compared to the cutters in the higher energy zones. The cutters in the higher energy zone should theoretically be removing a greater amount of material, but are unable to because they are limited by the cutters in the low energy zone. It is desirable to change the parameters such that the cutters in the low energy zone are able to remove the same amount of material as the cutters in the high energy zone. As previously noted, weight on bit is constant across the face of the drill bit so any adjustments would change the relative amount of material removed. The kinetic energy of the cutters cannot be changed since the kinetic energy is a function of the distance from the central axis. The composition of the formation is not able to be changed either and is typically constant across the face of the bit. The shape and composition of the cutters can be changed however.

Figure 6:
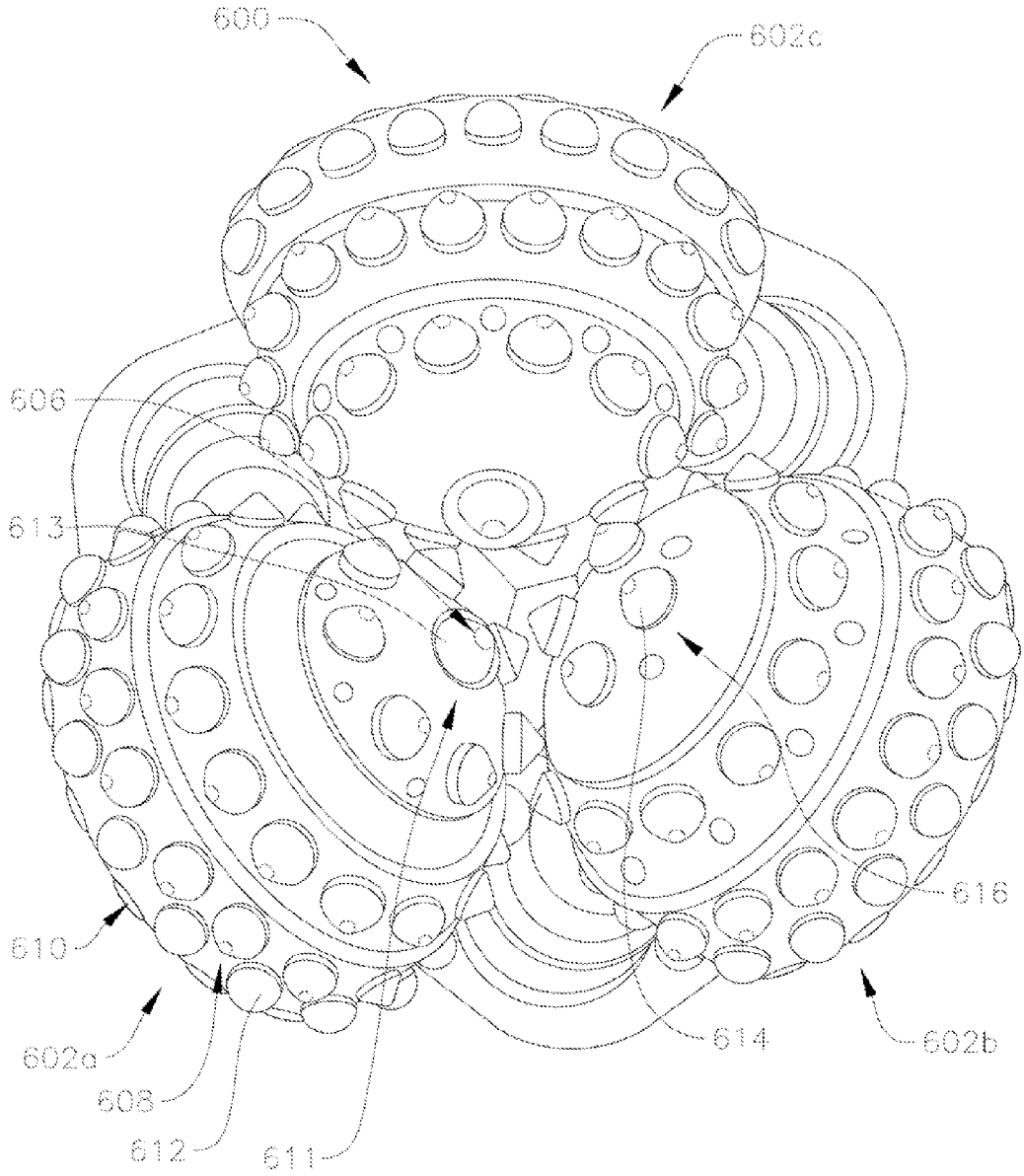
FIG. 6 is an orthogonal view of a face of an optimized energy equalized drill bit.

FIG. 6 is an illustration of an optimized drill bit 600 that does not have uniform distribution of cutters or cutter types. The drill bit 600 is a tri-cone type drill bit with three cones 602*a*, 602*b*, and 602*c*. The cones 602*a*, 602*b*, and 602*c* each have a gauge end 608 and a nose 606. (Note, these features and others are illustrated only with respect to one or more of the cones in FIG. 6 for simplicity and clarity. One of skill in the art would understand from the text and the drawings those elements present for the drill bit 600.) In this particular example, the cones 602*a*, 602*b*, and 602*c* have five rows of cutters including a heel row 610 at the gauge end 608 of the cone 602*a*. The gauge end 608 of the cone 602*a* has a first cutter 612 and the cone 602*a* continues to a fifth row, or nose row, 611 having a single fifth cutter 613 at the nose 606 of the cone 602*a*. As can be seen from FIG. 6, the rows of cutters do not have the same cutters across the different rows. For example, the first cutter 612 is a mild type cutter with a rounded profile while a cutter 614 in a fourth row 616 of cone 602*b* has a more aggressive profile with a pointed tip. Having different cutters in the different rows changes the performance of that cutter and therefore the potential volume removed by that that row of cutters.

Figure 7:
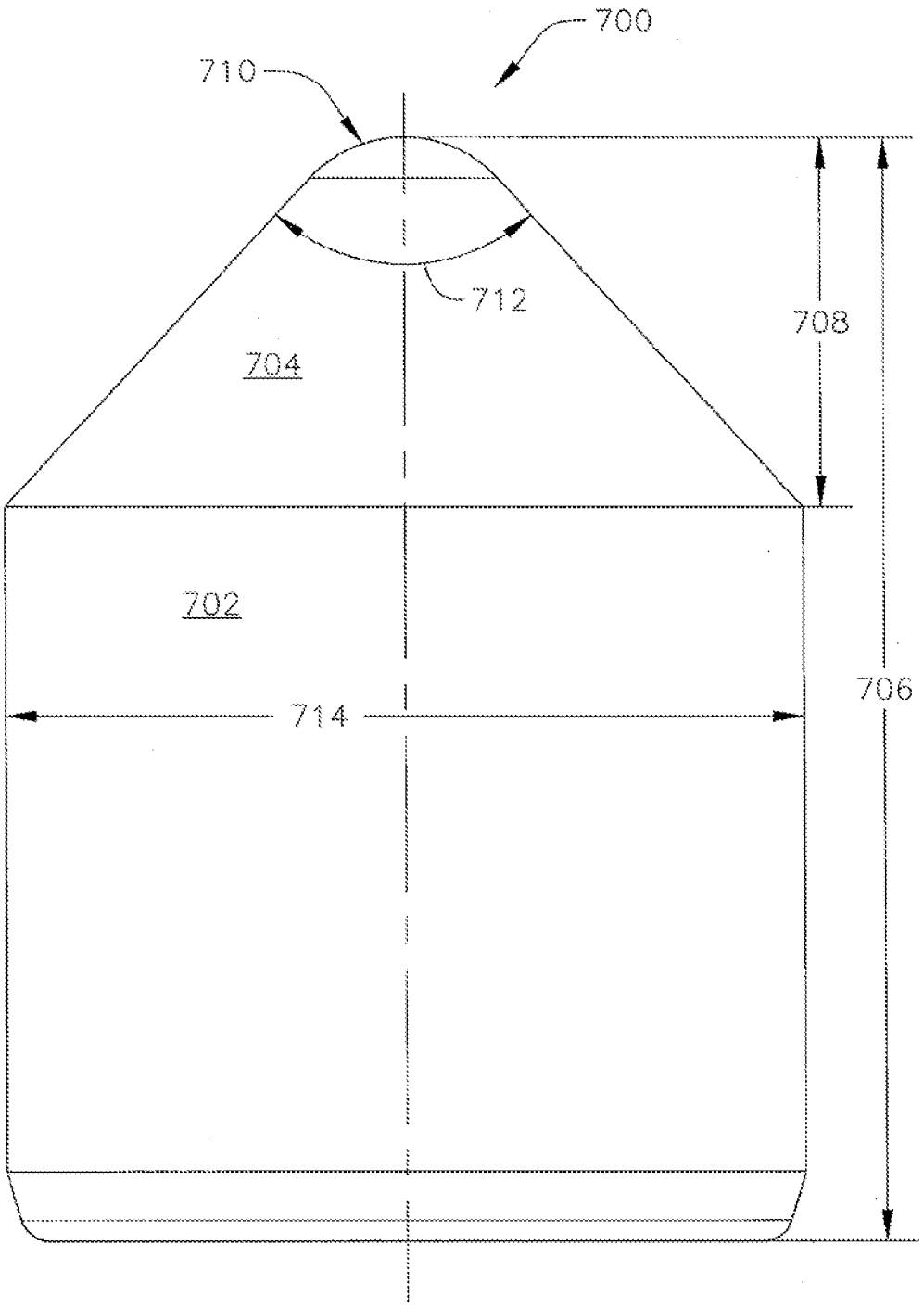
FIG. 7 is an orthogonal view of an insert, which may be used in an optimized energy equalized drill bit.

FIG. 7 illustrates an orthogonal view of a cutter 700 that may be used with embodiments of the present disclosure. The cutter has a body 702 and a tip 704. The body 702 is typically formed of a carbide substrate and the tip is typically formed of a polycrystalline diamond body, although other materials and/or coatings may be used, for example those additional cutter materials described herein. The geometry of the cutter is described by a height 706, a tip height 708, a tip radius 710, a tip angle 712, and an outside diameter 714. Applicants have discovered that geometrically sharp cutters are well suited for placement in the lower energy zone. A geometrically sharp cutter is defined as a cutter 700 having the tip radius 710 between 0.010 inch and 0.180 inch, the tip angle 712 between 30 degrees and 120 degrees, the ratio between the tip height 708 and height 706 between 0.1 and 0.7, and the outside diameter 714 between 0.100 inch and 1.250 inch. Applicants have found that the preferred range is for the tip radius 710 between 0.040 inch and 0.120 inch, the tip angle 712 between 60 degrees and 90 degrees, the ratio between the tip height 708 and height 706 between 0.2 and 0.5, and the outside diameter 714 between 0.250 inch and 0.875 inch.

A geometrically sharp cutter generally removes a greater amount of material at lower levels of kinetic energy. Therefore, geometrically sharp cutters can be used in zones of lower kinetic energy to remove a potential volume of material that is the same as the potential volume as a cutter in a high energy zone. Once the cutters in the different zones are removing a similar amount of material, the cutters are said to be equalized.

Generally, when a cutter is more aggressive, such as a geometrically sharp cutter, given the same drilling parameters, the aggressive cutter will wear faster than a less aggressive cutter. Given this information, one would expect that including cutters of different aggressiveness on the same bit would result in the more aggressive cutters wearing out before the less aggressive cutters and the drill bit life being reduced. In the past, different cutters were used on the drill bit on a trial and error basis to find a combination of cutters that gave the best performance and life for a drill bit. Such trial and error can be costly as the length of time to change a drill bit is significant and the required time to determine the performance of a drill bit can take as long as a week.

In order to avoid the process of trial and error, Applicants have discovered that a drill bit can be designed to have optimal utilization within each energy zones. Applicants have found that a drill bit has optimal utilization when the utilization of each energy zone is approximately the same. By substantially or approximately the same as it relates to utilization, Applicants mean that the utilization of a cutter in a first zone to remove a first volume is within plus-or-minus 5 percent of the utilization in a second zone for a second volume and, more preferably, within plus-or-minus 2.5 percent and, more preferable still, within plus-or-minus 1 percent. Likewise, by substantially or approximately the same as it relates to volume, Applicants mean that the volume of formation removed in a first zone is within plus-or-minus 5 percent of the volume removed in a second zone and, more preferably, within plus-or-minus 2.5 percent and, more preferable still, within plus-or-minus 1 percent.

As a consequence, the potential volume removed per unit area should be approximately or substantially the same in each of the zones. That is, the substantially or approximately the same as it relates to potential volume removed per unit area means that the potential volume removed per unit area of a first zone is within plus-or-minus 5 percent of the potential volume removed per unit area in another zone and, more preferably, within plus-or-minus 2.5 percent and, more preferable still, within plus-or-minus 1 percent.

When each of the energy zones have approximately or substantially the same utilization, the drill bit is said to be equalized. Applicants believe that the relationship between potential volume removed and utilization as defined above, was not previously recognized. Applicants, therefore, believe that drill bits known in the art inherently are not equalized in terms of their utilization.

Optimal utilization for a drill bit can be found in a number of ways. In one embodiment, the optimal utilization can be found by having zones of equal area, and then adjusting the geometry of the cutters so that the utilization of the zones is the same and the potential amount of material removed at each zone is the same. In another embodiment, the zones may remain the same as the non equalized drill bit, but the geometry of the cutters within the inner zone is adjusted to have the same utilization as the outer zone. In still other embodiments zones can be chosen without regard to the relative size of the zones and the cutter geometry adjusted to have an optimal utilization.

Figure 9:
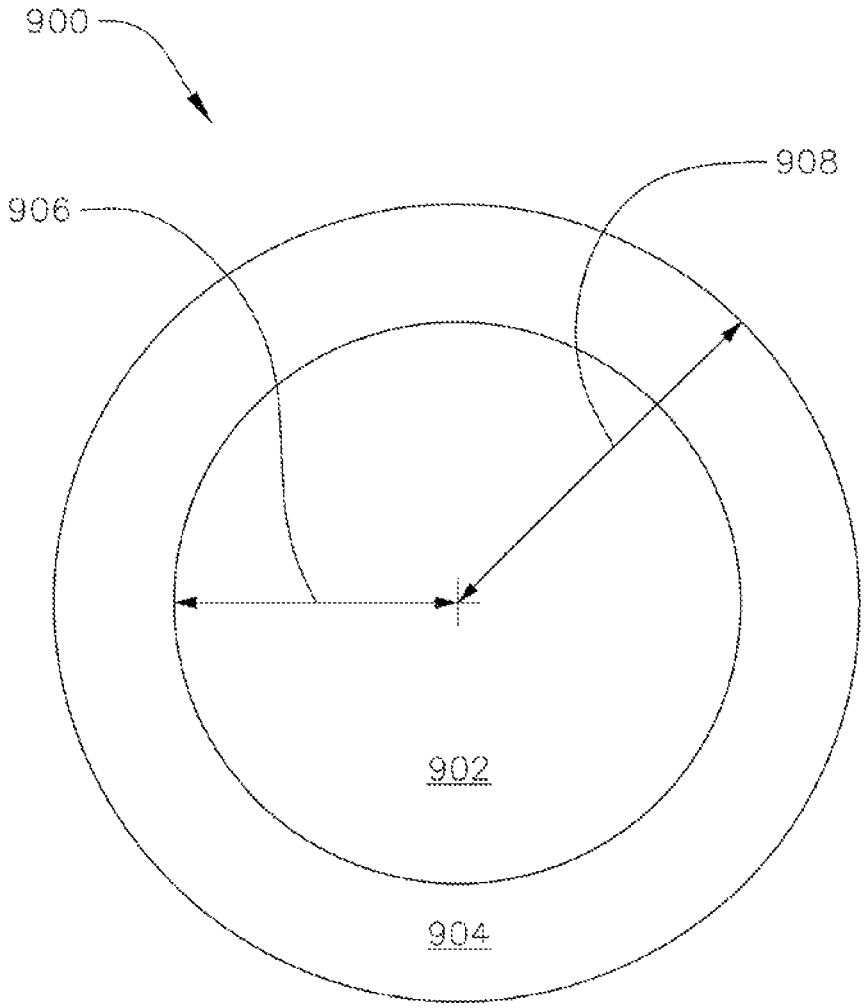
FIG. 9 is an energy map showing 2 zones of equal area and energy in an optimized energy equalized drill bit.

FIG. 9 illustrates an exemplary energy map 900 for a utilization equalized drill bit, such as drill bit 600, having energy zones 902, 904 of equal area. In this example, the zones are not chosen to have equal total kinetic energy, but are instead chosen to have an equal area. A first zone radius 906 of an optimized drill bit can be found as follows:

$$\frac{a1}{a2} = 1$$

$$1 = \frac{\left(\frac{r1}{r2}\right)^2}{1 - \left(\frac{r1}{r2}\right)^2}$$

$$1 - \left(\frac{r1}{r2}\right)^2 = \left(\frac{r1}{r2}\right)^2$$

$$1 = 2 * \left(\frac{r1}{r2}\right)^2$$

$$\frac{1}{2} = \left(\frac{r1}{r2}\right)^2$$

$$\sqrt{\frac{1}{2}} = \left(\frac{r1}{r2}\right)$$

$$0.707 = X$$

Therefore, when the first zone radius 906 of 0.707 times that of a second zone radius 908, the volume of material removed at the first zone 902 is roughly the same as the amount of material removed at the second zone 904. In a standard drill bit, the utilization in these two zones would be different with the first zone 902 having a higher utilization than the second zone 904. In order to keep the utilization approximately or substantially the same in each zone 902, 904, different cutters having different geometries, such as cutters 612 and 614 illustrated in FIG. 6, are utilized in each of the zones resulting in zones 902, 904 of substantially equal utilization. For example, because fewer cutters would potentially remove less material, fewer cutters within the second zone can be used to reduce the potential amount of material removed by the cutter zone until it was equal to the potential amount of material removed by the first zone. Alternatively, less efficient cutters could be used to reduce the potential volume of material removed in the second zone 904. Alternatively, more cutters could be placed in the first zone 902 to increase the total potential volume of material removed at the first zone or a cutter having a higher efficiency aggressive cutter could be used. The volume of material removed by a cutter can be approximated based on the distance from the central axis of the drill bit to the cutter and the cutters efficiency. The total volume of material removed for any energy zone on the drill bit is calculated by summing the volume of material removed for each individual cutter in that zone. Thus, by calculating the optimal radius of the first zone 902, a drill bit can be designed to ensure that the total potential volume of material removed by the first zone 902 is equal to the total potential volume of material removed by a second zone 904.

Figure 8:
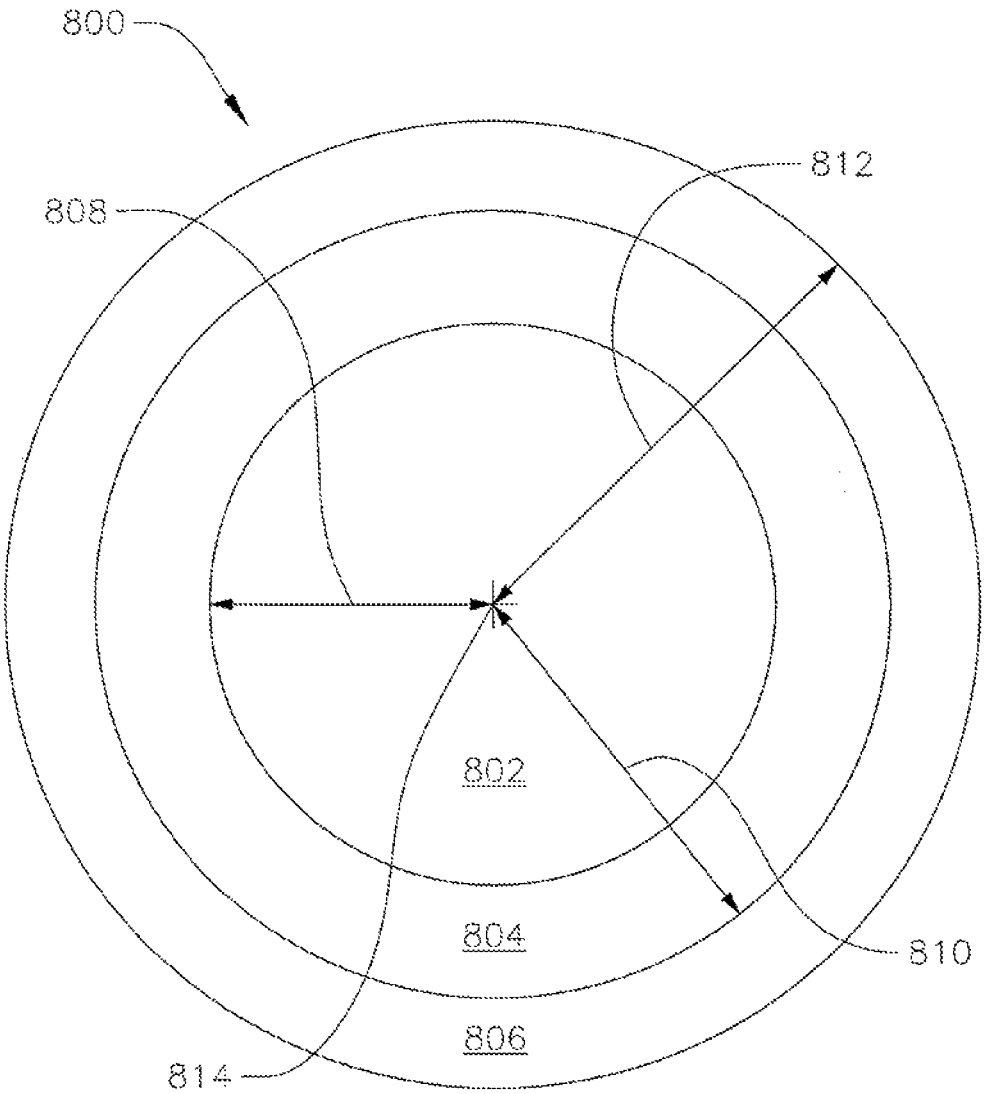
FIG. 8 is an energy map showing 3 zones of equal area and energy in an optimized energy equalized drill bit.

FIG. 8 illustrates a energy map 800 associated with an optimized drill bit identifying three energy zones 802, 804, 806 having an equal area and therefore remove an equal volume of material. An optimized drill bit, as defined, has each zone potentially removing the same volume of material and therefore each zone must have the same utilization. The radii 808, 810, 812 for each of zones 802, 804, 806 can be calculated as follows:

$$a1=a2=a3$$

$$r1=0.707*r2$$

$$r3^2-r2^2=r1^2$$

$$r3^2-r2^2=(0.707*r2)^2$$

$$r3^2=\frac{1}{2}r2^2+r2^2$$

$$r3^2=\frac{3}{2}*r2^2$$

$$r2^2=\frac{2}{3}*r3^2$$

$$r2=\sqrt[2]{\frac{2}{3}}*r3$$

$$r2=0.8165*r3$$

$$r1=0.707*0.8165*r3$$

$$r1=0.5773*r3$$

An optimized drill bit having three energy zones 802, 804, 806 with each having substantially or approximately the same area has a first zone radius 808 that is 0.5773 times the radius 812 of the third zone 806, and a second energy zone radius 808 that is 0.8165 times the radius 812 of the third zone 806. Of course, these ratios of radii and those ratios previously discussed are exemplary and may change depending on the type and diameter of the bit, the cutters employed, and other factors previously discussed.

It is also possible to design an optimized drill bit using an iterative process rather than the previously described calculations. For example, a volume of material removed at a first zone can be calculated and compared with a volume of material removed at a second zone. The relative radii can then be adjusted until the calculated volumes are equal. When the relative radii have been adjusted so that the calculated volumes are equal, the cutters can then be chosen such that the potential volume for each zone is equal and the cutters utilization is therefore equal.

Applicants have discovered that the optimal drill bit is one in which each zone removes the same volume of material as each other zone and where the zone have an equal potential removed volume of material. In the optimized drill bit, the total potential volume of material removed is the same for each energy zone and in turn the utilization is the same for each zone. With this fact in mind, an optimized drill bit could be designed as one having the same utilization in zones of varying area. For example, returning to the energy map of FIG. 4, it is possible to have an optimized drill bit with the first zone radius and second zone radius of the first zone and second zone even though their areas are not the same. To accomplish this, the ratio of the area of the first zone 402 to the area of the second zone 404, previously calculated to be 2.414, needs to be equal to the ratio of the potential volume removed by the first zone 402 and the second zone 404. Therefore, if the cutters were selected or chosen in zone 402 such that the total potential removed volume of material of the first zone 402 were 2.414 times that of the total potential volume of material removed of the second zone 404, the drill bit would be optimized.

Example 1

A test bore hole was drilled using a standard drill bit having a conventional energy zone pattern, like that of FIG. 4. That is, the conventional drill bit is one of the prior art and has not been optimized to have the utilization in a first zone be substantially the same in a second zone. As can be seen in Table 1 below, the standard drill bit of the first bit run had a rate-of-penetration (ROP) of 15.4 feet per hour and lasted 114.5 hours before failure.

An energy equalized drill bit having an energy map similar to the energy map FIG. 5 was then used in the same bore as the standard bit in bit run 2. That is, the cutter selection and the placement of the cutters were optimized to ensure that the energy density in a first zone (i.e., the kinetic energy in the first zone divided by the volume of formation removed in the first zone) was substantially equal to the energy density in a second zone. As the results in Table 1 indicate, the ROP of the energy equalized drill bit was able to be increased to 19.7 feet per hour and the energy equalized drill bit lasted 132.5 hours. The energy equalized drill bit lasted 18 hours or 16% longer than the standard drill bit. Even more impressive, the energy equalized drill bit was able to drill 2603 feet before failure, while the standard drill bit drill could only drill 1767 feet before failure. The energy equalized drill bit drilled 836 feet or 47% farther than the standard drill bit.

A standard drill bit of the same type as Run 1, i.e., one not optimized with the process and features described here, was then tested in bit run 3 in the same wellbore as the first standard drill bit and the energy equalized drill bit. This bit drilled with an ROP of 20.4 feet per minute to match, for practical purposes, the ROP of the energy equalized drill bit. Under these conditions, however, the standard drill bit in bit run 3 only was able to operate for 76.5 hours and drill 1560 feet before failure.

TABLE 1

| BIT RUN | BIT USED | ROP (FEET/HOUR) | LENGTH OF RUN (HOURS) | FOOTAGE DRILLED |
|---|---|---|---|---|
| 1 | Standard | 15.4 | 114.5 | 1767 |
| 2 | Energy Equalized | 19.7 | 132.5 | 2603 |
| 3 | Standard | 20.4 | 76.5 | 1560 |

Thus, it can be concluded that a drill bit optimized as described here performs unexpectedly and significantly better, particularly in terms of durability (i.e., hours of use) than those drill bits not optimized as described.

Example 2

A second test bore was drilled to verify the results of the first test. In the first bit run, the standard drill bit penetrated the formation at an ROP of 20.5 feet per hour, lasted 83.5 hours, and drilled 1712 feet before failure, the results of which are also indicated in Table 2 below.

In the second bit run, the energy equalized drill bit was then used in the same bore hole and penetrated the formation at a ROP of 25.7 feet per hour. The energy equalized drill bit lasted 124.0 hours, and drilled 3185 feet under these conditions.

Finally, in the third bit run another standard bit was then used in the same bore hole at a ROP of 25.1 feet per hour. The standard bit was able to penetrate the formation for 86.5 hours and drilled 2176 feet before failure. The energy equalized drill bit turned out to drill almost 50% farther than the standard drill bit.

TABLE 2

| BIT RUN | BIT USED | ROP (FEET/HOUR) | LENGTH OF RUN (HOURS) | FOOTAGE DRILLED |
|---|---|---|---|---|
| 1 | Standard | 20.5 | 83.5 | 1712 |
| 2 | Energy Equalized | 25.7 | 124.0 | 3185 |
| 3 | Standard | 25.1 | 86.5 | 2176 |

As with the first test, the results of the second test illustrated the unexpected and superior performance of the energy equalized drill bit, particularly in terms of operating life.

Methods of designing and building a drill bit that falls within the scope of the disclosure are also disclosed.

In a method of building a drill bit a drill bit is designed such that it has a first end, a second end spaced apart from the first end, a centerline, and a connection means connected to the bit body and configured to couple the bit body to a rotating means configured to provide rotation torque.

At least one cutting element is selected and positioned in a first zone of the drill bit, with the first zone extending between the centerline to a first radius. At least another cutting element is selected and positioned in a second zone of the drill bit, with the second zone extending between the first radius and a second radius greater than the first radius. A first volume the cutting element removes proximate the first zone when the bit body is rotated is calculated. A second volume the another cutting element removes proximate the second zone when the bit body is rotated is calculated.

The first radius is adjusted so that the first volume is substantially equal to the second volume. A first amount of energy required by the cutting element to remove the first volume is then calculated. A second amount of energy required by the another cutting element to remove the second volume is calculated. At least one of the cutting element and the another cutting element are adjusted such that the first amount of energy and the second amount of energy is substantially equal.

The one or more present inventions, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure.

The present disclosure, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A drill bit for earth boring, said drill bit comprising:

a bit body having a first end and a second end spaced apart from said first end, said bit body including a centerline;

a connection disposed at said first end configured to couple said bit body to a rotating means for providing rotational torque to said bit body at a rotational speed;

a first zone disposed at said second end having at least one cutting element, said first zone being circular and extending from said centerline to a first radius and having a first area, said at least one cutting element configured to remove a first volume of said earth in said first zone at said rotational speed, said first zone having a first kinetic energy, said first kinetic energy being the amount of energy required by said at least one cutting element to remove said first volume;

a second zone disposed at said second end having at least another cutting element, said second zone being annular and extending between said first radius and a second radius greater than said first radius and having a second area, said at least another cutting element configured to remove a second volume of said earth in said second zone at said rotational speed, said second zone having a second kinetic energy, said second kinetic energy being the amount of energy required by said at least another cutting element to remove said second volume; and wherein said first volume divided by said first area is substantially equal to said second volume divided by said second area and wherein said first kinetic energy is substantially equal to said second kinetic energy.

2. The drill bit of claim 1, wherein said second radius is equal to a maximum radius of said drill bit.

3. The drill bit of claim 1, further comprising at least one roller-cone.

4. The drill bit of claim 3, wherein said at least one cutting element and said at least another cutting element are positioned on said roller-cone.

5. The drill bit of claim 1, further comprising a bore through said bit body by which a drilling fluid flows into said bit body and at least one nozzle boss by which said drilling fluid flows out of said bit body.

6. The drill bit of claim 1, wherein said at least one cutting element is selected from a group consisting of a polycrystalline diamond cutter, a tungsten carbide insert, a metal tooth and a metal insert.

7. The drill bit of claim 1, wherein said first area is substantially equal to said second area.

8. The drill bit of claim 1, wherein said at least one cutting element has a tip radius and a tip angle, and wherein said tip radius is between 0.010 inches and 0.180 inches, and wherein said tip angle is between 30 degrees and 120 degrees.

9. The drill bit of claim 1, wherein said at least one cutting element has a tip radius and a tip angle, and wherein said tip radius is between 0.040 inches and 0.120 inches, and wherein said tip angle is between 60 degrees and 90 degrees.

10. The drill bit of claim 1, wherein the at least one cutting element has a different geometry than the at least another cutting element.

11. A method of designing a drill bit for earth boring, said method comprising:

designing a bit body having:

a first end;

a second end spaced apart from said first end;

a centerline;

a connection for coupling said bit body to a rotating means for providing rotational torque to said bit body;

selecting and positioning at least one cutting element in a first zone of said drill bit, said first zone being circular extending from said centerline to a first radius and said first zone having a first area;

selecting and positioning at least another cutting element in a second zone of said drill bit, said second zone being annular and extending between said first radius and a second radius greater than said first radius and said second zone having a second area;

calculating a first volume said cutting element removes proximate said first zone when said bit body is rotated and calculating a first kinetic energy, said first kinetic energy being the amount of energy required by said at least one cutting element to remove said first volume;

calculating a second volume said another cutting element removes proximate said second zone when said bit body is rotated and calculating a second kinetic energy, said second kinetic energy being the amount of energy required by said at least another cutting element to remove said second volume; and adjusting at least one of said cutting element and said another cutting element such that said first volume divided by said first area and said second volume divided by said second area are substantially equal and said first kinetic energy and said second kinetic energy are substantially equal.

12. The method of claim 11, wherein said second radius is selected to equal a maximum radius of said drill bit.

13. The method of claim 11, wherein said at least one cutting element and said at least another cutting element are positioned on a roller-cone.

14. The method of claim 11, wherein said at least cutting element is selected from a group consisting of a polycrystalline diamond cutter, a tungsten carbide insert, a metal tooth and a metal insert.

15. A drill bit for earth boring, said drill bit having a bit body, said bit body having a first end, a second end spaced apart from said first end, a centerline, and a connection for coupling said drill bit to a drill string, said drill bit being designed with the process comprising:

positioning at least one cutting element in a first zone of said drill bit, said first zone extending between said centerline to a first radius, said cutting element selected to remove a first volume of earth proximate said first zone when said bit body is rotated;

positioning at least another cutting element in a second zone of said drill bit, said second zone extending between said first radius and a second radius greater than said first radius, said another cutting element selected to remove a second volume of earth proximate said second zone when said bit body is rotated;

calculating a first amount of energy required by said at least cutting element to remove said first volume;

calculating a second amount of energy required by said at least another cutting element to remove said second volume; and adjusting at least one of said cutting element and said another cutting element such that said first amount of energy and said second amount of energy is substantially equal.

16. The drill bit of claim 15, further comprising:

calculating said first volume said at least one cutting element removes proximate said first zone when said bit body is rotated; and calculating said second volume said at least another cutting element removes proximate said second zone when said bit body is rotated.

17. The drill bit of claim 15, wherein said second radius is selected to equal a maximum radius of said drill bit.

18. The drill bit of claim 17, wherein said cutting element and said another cutting element are positioned on a roller-cone.

19. The drill bit of claim 15, wherein said cutting element is selected from a group consisting of a polycrystalline diamond cutter, a tungsten carbide insert, a metal tooth and a metal insert.

20. A drill bit for earth boring, said drill bit comprising:

a bit body having a first end and a second end spaced apart from said first end, said bit body including a centerline;

a connection for coupling said bit body to a rotating means for providing rotational torque to said bit body;

a first zone having at least one cutting element and a first area, said first zone extending from said centerline to a first radius, said at least one cutting element causing said first zone to have a first potential volume of material removed at a given rate of rotation and said first zone having a first potential kinetic energy, said first potential kinetic energy being the amount of energy required by said at least one cutting element to remove said first potential volume; and a second zone having at least another cutting element and a second area, said second zone extending between said first radius and a second radius greater than said first radius, said at least another cutting element causing said second zone to have a second potential volume of material removed at said given rate of rotation and said second zone having a second potential kinetic energy, said second potential kinetic energy being the of amount energy required by said at least another cutting element to remove said second potential volume, at least one of said cutting element and said another cutting element being selected such that said first potential volume divided by said first area is substantially equal to said second potential volume divided by said second area and said first potential kinetic energy is substantially equal to the second potential kinetic energy.

21. The drill bit of claim 20, wherein said first zone includes polycrystalline diamond geometrically sharp inserts and said second zone does not contain polycrystalline diamond geometrically sharp inserts.

22. The drill bit of claim 20, wherein said second radius is equal to a maximum radius of said drill bit.

23. The drill bit of claim 20, further comprising at least one roller-cone.

24. The drill bit of claim 23, wherein said at least one cutting element and said at least another cutting element are positioned on said roller-cone.

* * * * *